US005165341A

United States Patent [19]

John et al.

[11] Patent Number: 5,165,341

[45] Date of Patent: Nov. 24, 1992

[54] OFFSET PRINTING MACHINE

[75] Inventors: Thomas John; Georg Bock, both of Augsburg, Fed. Rep. of Germany

[73] Assignee: Man Roland Druckmaschinen AG, Offenbach am Main, Fed. Rep. of Germany

[21] Appl. No.: 542,975

[22] Filed: Jun. 25, 1990

[30] Foreign Application Priority Data

Jul. 6, 1989 [DE] Fed. Rep. of Germany ... 8908243[U]

[51] Int. Cl.[5] ..... B41F 7/02

[52] U.S. Cl. ..... 101/217; 101/350

[58] Field of Search ..... 101/217, 218, 219, 216, 101/212, 348, 349, 375, 350

[56] References Cited

U.S. PATENT DOCUMENTS

| | | | |
|---|---|---|---|
| 2,036,835 | 4/1936 | Sites | 101/142 |
| 3,587,463 | 6/1971 | Granger | 101/210 |
| 4,428,291 | 1/1984 | Dorow | 101/350 |
| 4,527,471 | 7/1985 | Dahlgren et al. | 101/350 |
| 4,590,857 | 5/1986 | Dahlgren | 101/350 |
| 4,696,229 | 9/1987 | Bezler et al. | 101/177 |
| 4,805,530 | 2/1989 | Kobler et al. | 101/350 |
| 5,009,158 | 4/1991 | John et al. | 101/219 |

FOREIGN PATENT DOCUMENTS

| | | |
|---|---|---|
| 1761715 | 4/1972 | Fed. Rep. of Germany . |
| 2902230 | 7/1980 | Fed. Rep. of Germany . |
| 3117341 | 11/1982 | Fed. Rep. of Germany . |
| 3705194 | 9/1988 | Fed. Rep. of Germany . |

*Primary Examiner*—Clifford D. Crowder
*Assistant Examiner*—J. R. Keating
*Attorney, Agent, or Firm*—Frishauf, Holtz, Goodman & Woodward

[57] ABSTRACT

To permit use of a yielding surface covering (16) on an ink application cylinder (7, 12, 32) offset printing machine, without slippage or rubbing between the ink application cylinder and an adjacent plate cylinder (5, 31), a drive is arranged between the plate cylinder and the ink application cylinder which provides for corresponding linear circumferential speed by changing the profile of engaged drive gears (6, 13) driving the ink application cylinder and the plate cylinder; the drive gears have the same pitch circle diameter. The yielding surface (16) on the ink application cylinder has a thickness of between 2–3% of the diameter of the ink application cylinder (12) and a durometer value of between about 60–70 on the Shore A scale; the ink application cylinder (12) has a diameter of about 99% of the diameter of the plate cylinder and in operation is engaged against the plate cylinder over an engagement zone of about 7–9 mm in circumferential length (1).

8 Claims, 1 Drawing Sheet

OFFSET PRINTING MACHINE

Reference to related patents, the disclosures of which are hereby incorporated by reference:

U.S. Pat. No. 2,036,835, sites (to which German No. 625 327 corresponds); U.S. Pat. No. 2,301,379. Reference to related publication: German Pat. No. 3117341 Reference to related application, assigned to the assignee of this application: U.S. Ser. No. 07/542,879, filed Jun. 25, 1990, now U.S. Pat. No. 5,009,158, John et al (claiming priority German Appln. P No. 39 22 559.3 of Jul. 8, 1989;

FIELD OF THE INVENTION

The present invention relates to rotary offset printing machines, and more particularly to such printing machines which have an ink application cylinder engageable with the plate cylinder, in which the ink application cylinder has a working surface which is resilient and yielding, and wherein the ink application cylinder is driven at the same speed as the drive speed of the plate cylinder, so that the plate cylinder and the ink application cylinder roll off against each other.

BACKGROUND

German Patent No. 31 17 341 describes an arrangement in which an ink application cylinder has effectively the same diameter as the plate cylinder. The plate cylinder may carry one or more printing plates thereon. The ink application cylinder, the diameter of which corresponds to the effective working diameter of the plate cylinder with the printing plates is driven to have the same circumferential speed as the plate cylinder and, in the engagement zone between plate cylinder and ink application roller, it rotates in the same direction. The ink application cylinder has a yielding surface.

The yielding surface of the ink application cylinder causes slippage and rubbing between the ink application cylinder and the plate cylinder, due to the compression of the yielding surface of the ink application cylinder as the consequence of engagement pressure between the two cylinders. This slippage and rubbing causes excessive wear on the printing plates, heats the cylinders, and also causes problems in connection with supply of damping fluid, typically water. The heating leads to expansion of the volume of the working surface of the ink application cylinder, which then changes the engagement relationships between the engaged cylinders, further increasing the rubbing effect. More damping fluid is emulsified in the ink due to the slippage and rubbing than would be the case if there were no slippage. This damping fluid then is no longer available for application to the surface of the printing plate in the region where printing is not to be effected. The result is scumming or tinting of the printing substrate. Increased supply of damping fluid counteracts such scumming. The ability of most inks to emulsify damping fluid has a limit, however, and thus, if too much damping fluid is applied, damping or water marks may occur on the substrate. Additionally, the viscosity or flowability of many inks is undesirably affected if the proportion of water emulsified therein is too high.

U.S. Pat. No. 2,036,835, sites, to which German Patent 625,327 correspond discloses that slippage or rubbing occurs between the plate cylinder and the blanket cylinder of an offset printing machine if both cylinders have exactly the same working diameters. To avoid such slippage, it has been proposed to slightly increase the diameter of the plate cylinder and decrease the diameter of the blanket cylinder. When using incompressible blankets, this opposite relationship then avoids slippage and rubbing. Rubber blankets which are incompressible deform, however, so that, upon compression of the rubber blanket by the plate cylinder, a bulge will be formed.

It has been found that changing the diameters of the plate and rubber blanket cylinder is not a suitable solution when using compressive or compressible blankets on the blanket cylinder. Compressible blankets decrease the volume due to compression by the plate cylinder. The change in the diameters of the respective cylinders does not remove the rubbing or slippage between the cylinders.

Using excess damping fluid, regardless of the diametrical relationship of the blanket cylinder and the plate cylinder, raises special problems when inkers are used which include an anilox cylinder to supply ink. Returned or fed-back ink-damping fluid emulsions hardly evaporate from an anilox cylinder. There is, therefore, only a very narrow range in which just sufficient, but not excessive damping fluid can be supplied. Adjusting the quantity of supply of damping fluid within this narrow range is difficult and expensive. It has been found, further, that the proportion of damping fluid emulsified within the ink increases as the slippage or rubbing increases.

The discussion in the aforementioned U.S. Pat. No. 2,036,835 sites with respect to relative diametric relationships of the blanket cylinder and the plate cylinder is restricted specifically to these two cylinders, and what could happen if the ink application has a compressible surface is not disclosed.

THE INVENTION

It is an object to provide a printing system in which slippage or rubbing between the plate cylinder and an ink application cylinder is effectively eliminated, even if the spacing of the shaft diameters between the plate cylinder and the ink application cylinder must be changed to a far greater extent than possible by mere changing the profile or gear tip dimensions of engaged gears.

Briefly, in accordance with a feature of the invention, the ink application cylinder has a diameter of about 99% of the diameter of the plate cylinder, and a yielding surface covering thereon which has a thickness, when uncompressed, of between about 2–3% of the diameter of the ink application cylinder, and a hardness or yieldability or durometer value of between about 60 to 70 on the shore A scale. This arrangement permits driving the ink application cylinder at the same speed as the plate cylinder and, further, in operation of the machine, to apply a compressive force between the ink application cylinder and the plate cylinder, when they are in engagement with each other, such that the length, in circumferential direction, of the engagement region will be between about 7–9 mm.

The arrangement has the advantage that rubbing or slippage is effectively eliminated, the cylinders can readily be placed in the printing machine as desired, and application of ink from, for example, an anilox roller with a short-train inker is entirely feasible. Further, the gear of the ink application roller, can be used as a drive gear to transmit torque to the anilox roller, since the speed relationship between the anilox roller and the ink application, or the plate cylinder, can be other than 1:1.

DRAWINGS

FIG. 1 is a highly schematic side view of the cylinder and roller arrangement in an offset printing machine system; and FIG. 2 is a fragmentary side view of a printing machine system in accordance with the invention.

DETAILED DESCRIPTION

Figure 2:
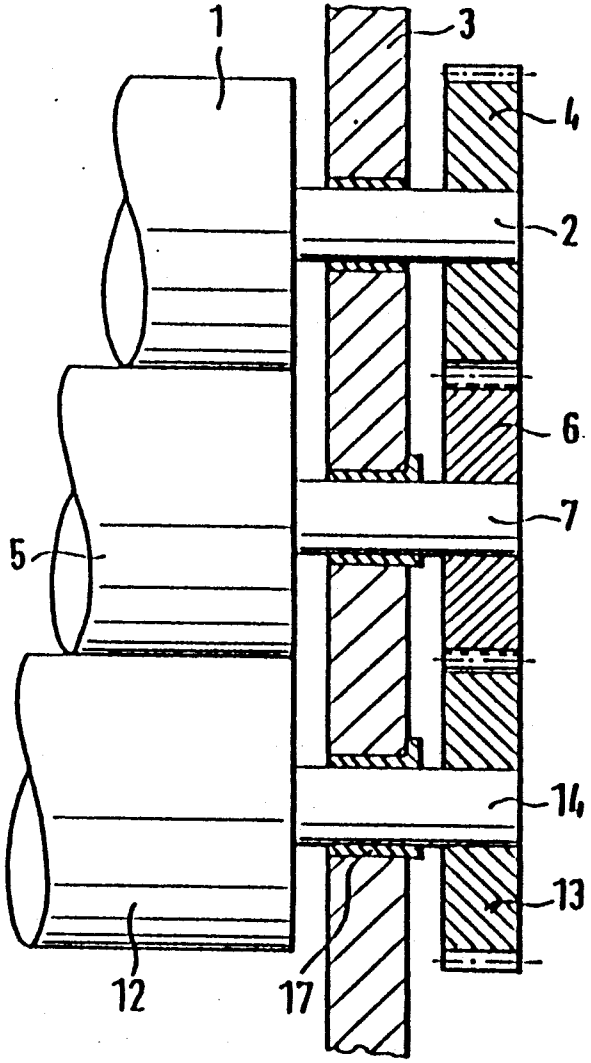
Figure 1:
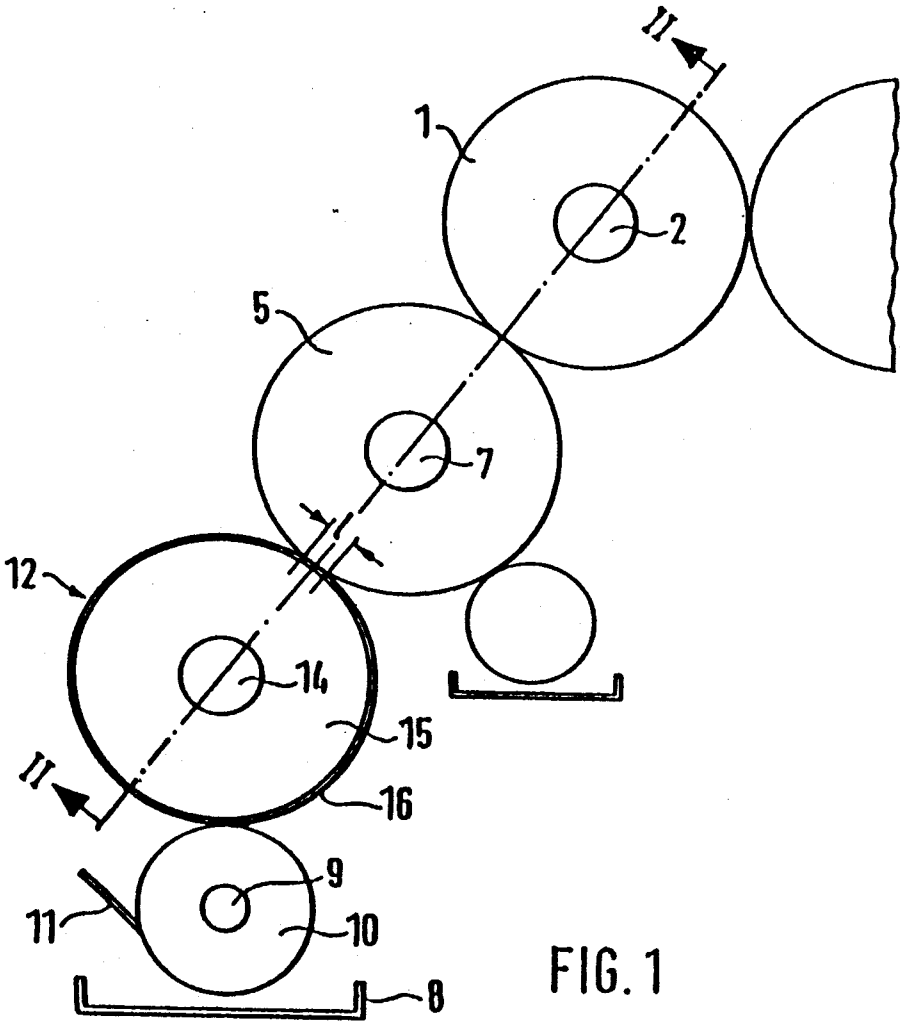

A rubber blanket cylinder 1 is retained on a shaft 2, which is journalled in eccentric bearings, retained in side walls, or a frame of the printing machine, of which only wall 3 is shown. A plate cylinder 5 is engaged against the rubber blanket cylinder, to cooperate therewith, the plate cylinder 5 being secured on a shaft 6 which is suitably journalled in the side walls. The plate cylinder 5 receives ink from an ink application cylinder 12 which is coupled to a shaft 14, retained in adjustable eccenter bearings 17 in the side walls 3, 4. An anilox roller 10 is secured in the side walls by a shaft 9, to supply ink to the ink application cylinder 12, see FIG. 1.

Preferably, the eccentric bearings are constructed as double eccenters of any suitable arrangement, as well known in the printing machinery field. The anilox roller 10 can also be retained in eccentric bearings. The anilox roller 10 receives ink from an ink trough 8. Ink is stripped off the anilox roller 10 by a doctor blade 11. The ink supply system is shown only schematically and may be of any suitable and well known form. Ink is applied to a yielding layer 16 of elastic, ink accepting material on cylinder 12.

Shaft 14 of the ink application roller 12 has a gear 13 secured thereto. Gear 4 of the blanket cylinder 1 and gear 6 of the plate cylinder 5 as well as the gear 13 of the ink application cylinder 12 have the same pitch circle diameter and the same gear modulus. Thus, cylinders 1, 5 and 12 rotate with the same speed.

In accordance with a feature of the invention, the ink application cylinder 12 has a diameter of about 99% of the diameter of the plate cylinder 5. The ink application cylinder 12 has a rigid strong core 15 on which a layer 16 of elastic ink accepting material is applied. In accordance with a feature of the invention, the layer 16 has a thickness of between about 2–3% of the diameter of the ink application cylinder 12 and a durometer value of between about 60 to 70 in the shore A scale. Preferably, the layer 16 is made of rubber or similar material, for example material suitable to make blanket for blanket cylinders. The layer 16, suitably, is applied to the core 15 of the cylinder 12 by vulcanizing the layer thereon. In order to compensate for reduction in the spacing between the shafts 7 and 14 from each other due to reduction in the diameter of the ink application cylinder 12 over that of the plate cylinder 5, the teeth of the gear 13 are made with a negative profile shift.

The eccentric bearing 17—which is matched by a similar eccentric bearing at the other end of the cylinder 12 permits engaging the ink application cylinder 12 against the plate cylinder 5 in such a manner that, in operation of the machine, a contact region having a length 1 of from between about 7–9 mm (see FIG. 1), with reference to circumferential direction of the plate cylinder 5 will result.

It has been found that this arrangement effectively prevents slippage or rubbing between the plate cylinder 5 and the ink application cylinder 12. The quantity of damping fluid which will be emulsified in the ink at the contact region is thereby minimized. The quantity of damping fluid supplied to the plate cylinder thus can be varied within a wider range than heretofore, without causing water marks, striping, or ghosting. Precise adjustment of the damping fluid, therefore, is no longer necessary and adjustment can be carried out rapidly, even by semiskilled machine operators.

We claim:

1. Offset printing machine having
- a blanket cylinder (1);
- a plate cylinder (5) in engagement with the blanket cylinder;
- an ink application cylinder (12) having a yielding surface covering (16) of ink accepting material in engagement with the plate cylinder (5);
- an ink supply roller (10),
- means (4, 6, 13) for driving said cylinders at the same rotary speed,
- and wherein, in accordance with the invention,
- the ink application cylinder (12) has a diameter of substantially 99% of the diameter of the plate cylinder (5) but less than 100% thereof; and
- the yeilding surface covering (16) of the ink application cylinder (12) has
  - a thickness of between about 2–3% of the diameter of the ink application cylinder (12),
  - a durometer value of between about 60–70 on the Shore A scale; and
- wherein, in operation of the machine, the engagement of the ink application cylinder (12) and the plate cylinder (5) forms an engagement region or zone which has a circumferential length (1) of about 7–9 mm.

2. The machine of claim 1, wherein the ink application cylinder (12) has a core (15); and
- said yielding material comprises a layer of elastic, ink accepting rubber material applied by vulcanization on the core (15) of the ink application cylinder (12).

3. The machine of claim 1, wherein said driving means include a cylinder gear means (6) secured to a plate cylinder shaft (7) for driving the plate cylinder (5);
- an ink cylinder gear means (13) coupled to an ink cylinder drive shaft (14) for driving the ink application cylinder (12);
- and wherein the pitch circle diameters of the plate cylinder gear means (6) and of the ink cylinder gear means (13) are the same, and the profiles of the gears of one of said gear means are formed with a profile shift to permit compression of said yielding surface covering (16) on the ink application cylinder (12) and drive of both cylinders at the same circumferential speed.

4. The machine of claim 1, wherein said driving means include a cylinder gear means (6) secured to a plate cylinder shaft (7) for driving the plate cylinder (5);
- an ink cylinder gear means (13) coupled to an ink cylinder drive shaft (14) for driving the ink application cylinder (12);
- and wherein the pitch circle diameters of the plate cylinder gear means (6) and of the ink cylinder gear means (13) are the same, and the profile of the gear of one of said gear means is formed with a negative profile shift to permit compression of said yielding surface covering (16) on the ink application cylinder (12) and drive of both cylinders at the same circumferential speed.

5. The machine of claim 1, wherein said ink supply roller (10) comprises an anilox roller.

6. The machine of claim 2, wherein said ink supply roller (10) comprises an anilox roller.

7. The machine of claim 3, wherein said ink supply roller (10) comprises an anilox roller.

8. The machine of claim 4, wherein said ink supply roller (10) comprises an anilox roller.

* * * * *